US006684864B1

(12) United States Patent
Busen et al.

(10) Patent No.: US 6,684,864 B1
(45) Date of Patent: Feb. 3, 2004

(54) METHOD FOR REMOVING OIL FROM CRANKCASE VENTILATION GASES AND DEVICES FOR IMPLEMENTING SAID METHOD

(75) Inventors: Jürgen Busen, Ahaus (DE); Sieghard Pietschner, Greven (DE)

(73) Assignee: Ing. Walter Hengst GmbH & Co. GmbH, Muenster (DE)

( * ) Notice: Subject to any disclaimer, the term of this patent is extended or adjusted under 35 U.S.C. 154(b) by 0 days.

(21) Appl. No.: 09/720,312

(22) PCT Filed: Apr. 19, 2000

(86) PCT No.: PCT/EP00/03549

§ 371 (c)(1),
(2), (4) Date: Jan. 29, 2002

(87) PCT Pub. No.: WO00/65206

PCT Pub. Date: Nov. 2, 2000

(30) Foreign Application Priority Data

Apr. 22, 1999 (DE) ..... 199 18 311

(51) Int. Cl.[7] ..... F02M 25/06
(52) U.S. Cl. ..... 123/572; 123/41.86
(58) Field of Search ..... 123/572, 573, 123/574, 41.86

(56) References Cited

U.S. PATENT DOCUMENTS

| | | | | |
|---|---|---|---|---|
| 4,878,923 A | | 11/1989 | Muller | |
| 4,925,553 A | | 5/1990 | Smith | |
| 5,158,585 A | | 10/1992 | Saho et al. | |
| 5,460,147 A | * | 10/1995 | Bohl | 123/572 |
| 5,944,001 A | * | 8/1999 | Hutchins | 123/572 |
| 5,964,207 A | * | 10/1999 | Clauss et al. | 123/572 |
| 6,279,556 B1 | * | 8/2001 | Busen et al. | 123/572 |

FOREIGN PATENT DOCUMENTS

DE 3 128 470 1/1983

* cited by examiner

*Primary Examiner*—Marguerite McMahon
(74) *Attorney, Agent, or Firm*—Sonnenschein Nath & Rosenthal LLP

(57) ABSTRACT

The invention relates to a method for de-oiling crankcase ventilation gases of an internal combustion engine wherein an oil separating element, like a cyclone has crankcase ventilation gases flowing therethrough, and the oil droplets contained therein are separated. The method provides that the volume stream of the crankcase ventilation gases is divided in at least two partial volume streams, and at least one partial volume stream is guided through at least one oil separating element, wherein the magnitude of the at least two partial volume streams is controlled depending on the magnitude of the volume stream. Furthermore the invention relates to apparatus for accomplishing the method.

34 Claims, 4 Drawing Sheets

METHOD FOR REMOVING OIL FROM CRANKCASE VENTILATION GASES AND DEVICES FOR IMPLEMENTING SAID METHOD

BACKGROUND OF THE INVENTION

The present invention relates to a method for de-oiling crankcase ventilation gases and apparatus for accomplishing the method.

The method and the associated apparatus are known from practical experience resulting from a plurality of application cases. The known separating elements for de-oiling crankcase ventilation gases, in most cases cyclones, comprise two decisive operation values namely the separating efficiency and the differential pressure depending on the volume stream of the streaming crankcase ventilation gases, the so called Blow-By-Gases. Depending on the operation a volume stream area will result wherein the separating efficiency and also the differential pressure of the separating element are optimally adjusted to the requirements of the internal combustion engine.

Therein the volume stream of the crankcase ventilation gases is dependent on operating values like load condition and numbers of revolution of the associated internal combustion engine, and the wear condition thereof. When operating an internal combustion engine such a large volume stream area will result from these values that disadvantageously it cannot be covered with one separating element because the optimal operating condition of the separating element is only met in a very small area. In other areas the separating efficiency, e.g., with small volume streams, will decrease below a required level, or with a correspondingly larger volume stream the resulting differential pressure will exceed a tolerable value.

SUMMARY OF THE INVENTION

Therefore, it is the object of the invention to provide a method and associated apparatus for de-oiling crankcase ventilation gases which will operate under all operating conditions of the internal combustion engine in an optimal area.

The method according to the invention is characterized in that the volume stream of the crankcase ventilation gases is divided in at least two partial volume streams, and at least one partial volume stream is guided through at least one oil separating element, wherein the magnitude of the at least two partial volume streams is controlled depending on the magnitude of the volume stream. Therein advantageously is attained that by a corresponding control with small volume streams only one separating element is used, and that with large volume streams the at least two separating elements are used. Of course it is possible to use three or four or even more separating elements each of them being controlled such that the fed partial volume stream is optimally cleaned from oil droplets.

The advantages are that the separating efficiency and the differential pressure are always kept in the optimal area, and this is accomplished even under extreme operating conditions like push operation and/or extreme wear of the internal combustion engine.

Several apparatus for accomplishing the method according to the invention are stated wherein in a first embodiment at least two oil separating elements arranged in parallel are present with a common control element arranged upstream which divides the volume stream of the crankcase ventilation gases depending on the magnitude thereof in at least two partial volume streams and guides these streams to the at least two oil separating elements. The advantage of this solution is the relatively simple construction with only one control element.

An alternate embodiment provides that at least two oil separating elements are provided arranged in parallel with each having a control element which depending on the magnitude of the fed partial stream, controls the downstream arranged oil separating elements, i.e., opens, or closes, or partly opens. In this embodiment a control element is necessary for each oil separating element which because of the smaller partial stream volume to be received mostly is smaller compared with the first embodiment.

It is advantageous that in the last embodiment an additional common control element is arranged upstream of the other control elements which additional control element divides the volume stream of the crankcase ventilation gases depending on the magnitude thereof in correspondingly many partial volume streams. Therein the common control element is connected to the downstream arranged several control elements in a suitable mariner, e.g., by electrical control signal lines such that control commands from the common control elements may be transferred to the downstream arranged control elements, and in particular control signals for opening or closing may be transferred.

In a further alternative it is provided that at least two oil separating elements are provided arranged in parallel, each of them having a partial stream flowing therethrough wherein the magnitude thereof may be controlled by a control element associated with an oil separating element with the control element being arranged in parallel with the oil separating element regarding the flow direction. In this arrangement the number of the control elements is equal to the number of oil separating element however, these oil separating elements do not have the full partial streams flowing therethrough, whereby in many cases a smaller construction is possible.

Furthermore, a further alternative is provided wherein at least two oil separating elements are provided arranged in series with each a control element arranged upstream, wherein each control element, depending on the fed volume streams, divides this stream in two partial streams with the one thereof flowing to the control element in front of the downstream arranged oil separating element, and wherein the other partial stream flows through a by-pass line which passes by the downstream arranged oil separating element. In the latter embodiment, a too large volume stream may be passed by the oil separating elements if this is tolerable in certain operating conditions, or is required.

In all preceding embodiments of the apparatus, in a first simple embodiment, the control element may be a passive element which may be actuated directly by the volume stream or by a force exerted by this stream. In this manner on the one hand a simple and inexpensive construction is attained, and on the other hand a high reliability during operation is attained.

Alternately, the control element may be an active element that, depending on a control signal, may be actuated with the control signal resulting from a measurement of the volume stream. This embodiment requires a somewhat higher technical effort, however, enables a more accurate control and a stronger influence, e.g., on the course of control characteristics.

Regarding the measurement of the volume streams mentioned above, a first further development of the apparatus provides that a measuring device for measuring the volume streams encompasses a hot wire having an electrical current flowing therethrough, and that the control element may be actuated electrically. As an advantage, the measurement of the volume stream and the actuation of the control element is attained electrically such that a simple transfer of measuring signals in control signals may be possible purely electrically.

An alternate embodiment provides that a measuring device for measuring the volume stream encompasses a venturi pressure sensor, and that the control element may be actuated mechanically, preferably by a diaphragm acting on a tappet of this control element. This embodiment has the advantage that the measurement and also the actuation of the control element may be attained purely mechanically such that a transfer of mechanical measuring values in electrical signals or vice versa from electrical signals to mechanical control values is not necessary.

In order to keep the apparatus compact and simple and easy to mount, preferably it is provided that the control element is arranged directly in the gas inlet of the associated oil separating element, and that by means of the control element, the inlet cross-section of the oil separating element may be varied, preferably continuously or in several steps between an open and a closed position.

An alternate embodiment of the apparatus which has the same effect, provides that the control element is arranged directly in the gas outlet of the associated oil separating element, and that by means of the control element the gas outlet cross-section of the oil separating element may be varied, preferably continuously or in several steps, between an open and a closed position.

In order to avoid, in the embodiment of the apparatus described last, that with a closed gas outlet cleaned gas escapes through the oil outlet of the oil separating element in a non-required fashion, it is furthermore provided that in addition to the control element directly in the oil outlet of the associated oil separating element, an additional control element is arranged, that by means of the additional control element the oil outlet cross-section of the oil separating element may be varied, preferably continuously or in several steps between an open and a closed position, and that the control element and the additional control element are coupled with each other, and may be commonly adjusted. This coupling of the control element and the additional control element ensures that the oil outlet is open only with an open gas outlet, and that with a closed gas outlet also the oil outlet is closed.

In a concrete embodiment of the coupled unit of control element and additional control element, it is proposed that the control element and the additional control element each comprise a valve ball biased in closing direction by weight or spring force, wherein the valve ball of the control element has a larger diameter than the valve ball of the additional control element, and wherein the two valve balls are connected with each other by a coupling element for common adjustment. Hereby a common and identical movement of the valve balls, and thereby a coupled adjustment of control element and additional control element, is guaranteed. In its simplest embodiment the coupling element is a thin and light rod connecting the two valve balls with the rod forming an asymmetrical dumbbell with the two valve balls.

BRIEF DESCRIPTION OF THE DRAWINGS

Different embodiments of the invention subsequently are further described referring to a drawing. The figures of the drawing illustrate.

DETAILED DESCRIPTION OF THE PREFERRED EMBODIMENTS

Figure 1:
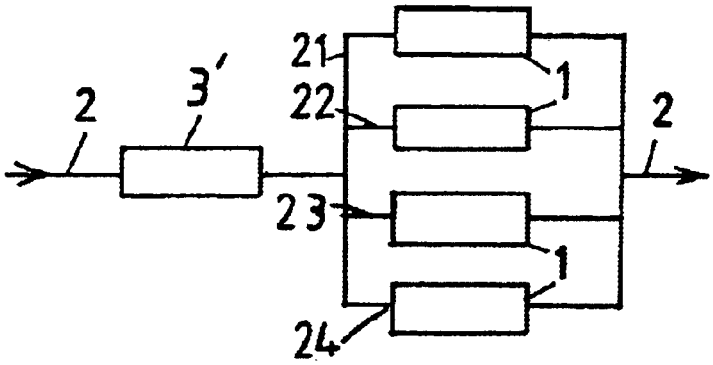
FIG. 1 is a schematic block diagram illustration of a first embodiment of the apparatus according to the invention.

Referring to FIG. 1, a volume stream 2 of the crankcase ventilation gases flows in direction of the arrow to a common control element 3' which divides the volume stream 2 in up to four partial streams 21, 22, 23, 24, each of them flowing through an oil separating element 1, whereupon the partial streams, by means of corresponding design of the lines, are re-united to a de-oiled volume stream 2 which is guided toward the right side in FIG. 1 in a known manner, e.g., into the suction passage of the associated internal combustion engine. Depending on the present magnitude of the arriving volume stream 2, more or less of the four oil separating elements 1 being provide are used of course the partial streams 21 to 24 need not be equal to each other, however, they may be equal under certain operating conditions of the associated internal combustion engine.

Figure 2:
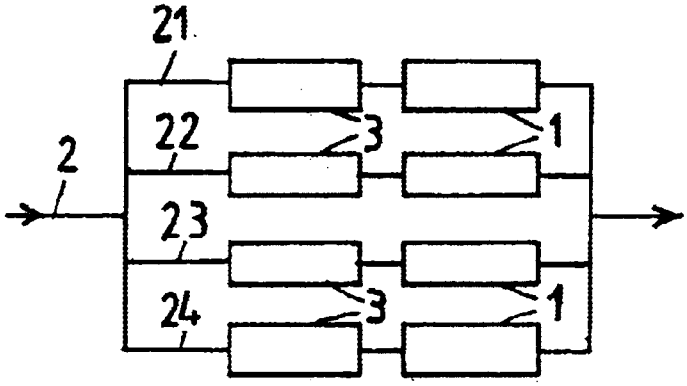
FIG. 2 is a schematic block diagram illustration of a second embodiment of the apparatus according to the invention.

In FIG. 2, the volume stream 2 is divided in four partial streams 21 to 24 by branched lines, wherein each partial stream flows through a control element 3, and thereupon through an oil separating element 1 whereupon the four de-oiled partial streams 21 to 24 are thereafter re-united.

Figure 3:
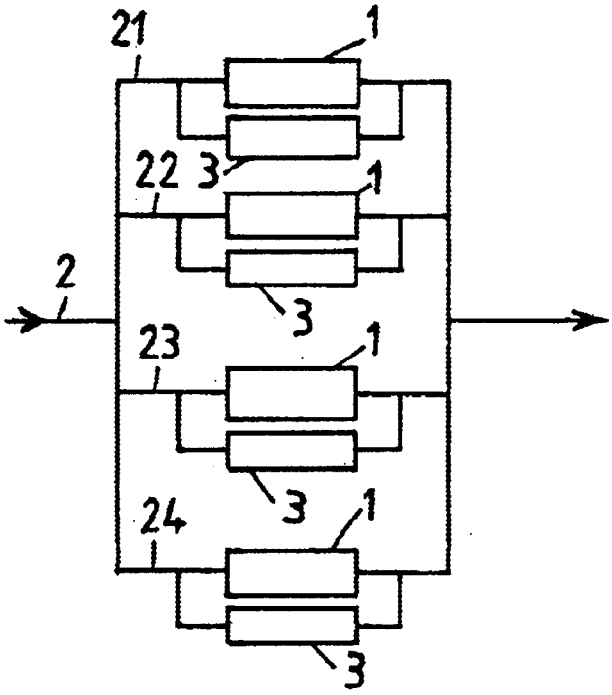
FIG. 3 is a schematic block diagram illustration of a third embodiment of the apparatus according to the invention.

In FIG. 3, the volume stream 2 again is divided in four partial streams 21 to 24, whereupon each partial stream 21 to 24, after division in two flow paths, flows through a pair of an oil separating element 1, and a control element 3, which are arranged in parallel, whereupon the two flow paths are thereafter re-united, and also further thereafter the four partial streams 21 to 24 are re-united to a common, deoiled volume stream 2.

Figure 4:
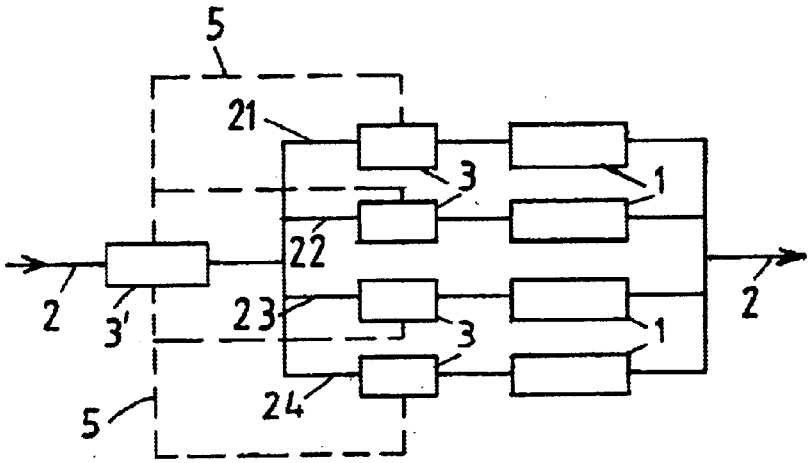
FIG. 4 is a schematic block diagram illustration of a fourth embodiment of the apparatus according to the invention.

In FIG. 4, the volume stream 2 firstly flows in total through a common first control element 3', and after leaving it is divided in four partial streams 21 to 24, whereupon each partial stream flows through a control element 3, and thereupon flows through an oil separating element 1, whereupon the four partial streams are thereafter re-united to a common de-oiled volume stream 2. In FIG. 4 the signal transfer means 5, e.g., electrical control signal lines, are indicated by dashed lines between the common first control element 3' and the four control elements 3 which transfer control signals. It is visible that the common control element 31 is connected to each downstream arranged control element 3 by signal transfer means 5.

Figure 5:
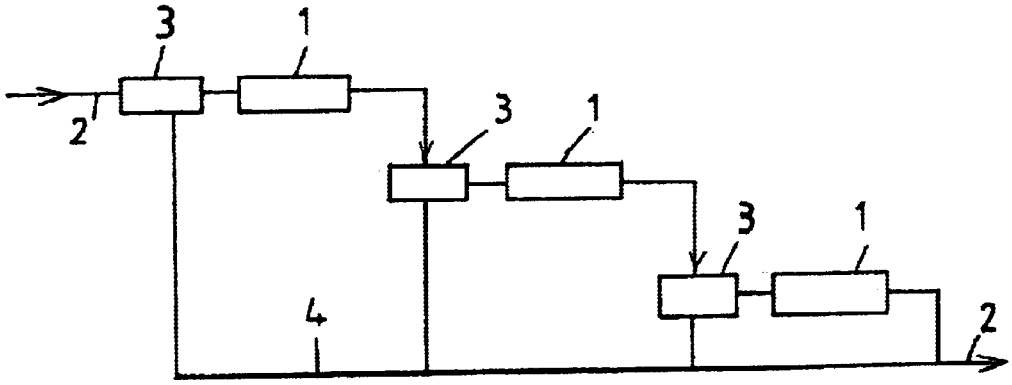
FIG. 5 is a schematic block diagram illustration of a fifth embodiment of the apparatus according to the invention each in form of a block diagram of the apparatus according to the invention.

FIG. 5 illustrates an embodiment wherein the common volume stream 2 is firstly guided into a control element 3 whereupon it is divided in two partial streams. The one partial stream in FIG. 5 flows downward, and then to the right through a by-pass line 4, and will not flow through an oil separating element. The other partial stream flows through an oil separating element 1 and further through a downstream arranged control element 3 whereupon again it is divided as in the first step. A first partial stream flows into the by-pass line 4, and the other partial stream flows through an oil separating element 1 and from there further to a third control element 3. Also in this case there is a division in one partial stream which flows into the by-pass line 4, and a further partial stream which flows through the third oil separating element 1 before flowing into a common line which receives the volume stream 2 which also contains the partial stream which has flowed through the by-pass line 4.

Figure 6:
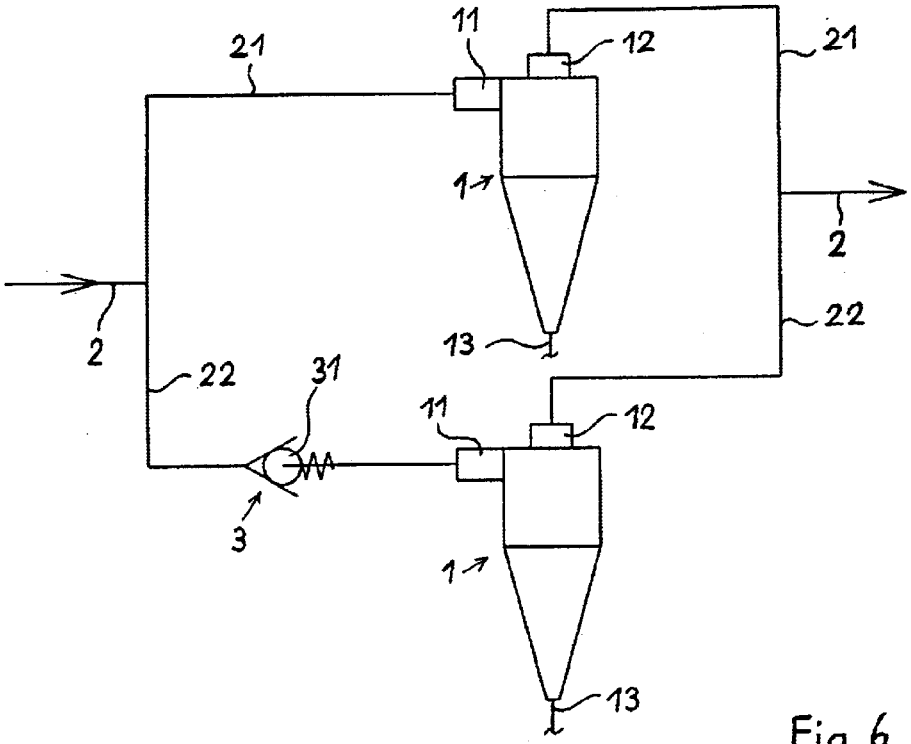
FIG. 6 is an embodiment of the apparatus with two cyclones as oil separating elements arranged in parallel, and a control element all in a schematic view.

In a schematic view in FIG. 6 an embodiment of the apparatus is illustrated wherein two cyclones as oil separating elements 1 arranged in parallel and a single control element 3 are provided. A volume stream 2 arrives from the crude side, e.g., out of the crankcase of a non-illustrated internal combustion engine, with the volume stream consisting of crankcase ventilation gas loaded with oil droplets. The volume stream 2 is divided into two partial streams 21, 22. The first partial stream 21 is guided into the gas inlet 11 of a first cyclone 1 which is illustrated on top of FIG. 6. In the interior of the cyclone 1 a separation of clean gas and oil is attained in a known fashion, wherein the clean gas leaves the cyclone 1 upwards through a gas outlet 12, whereas the separated oil flows through the oil outlet 13 provided below.

As no control element is provided in the first cyclone 1 this cyclone 1, during operation of the associated internal combustion engine has gas continuously flowing through it.

The second cyclone 1 is charged with the second partial stream 22 of the crankcase ventilation gases. This cyclone 1 is provided with a control element 3 at the upstream side, which in this case is formed by a ball valve 31 biased in a closing direction. Because of the biasing force in the closing direction, the control element 3 is closed with a small volume stream 2, only with a stronger increase of the volume stream 2 will the valve 31 open because of the increasing volume stream, in this case of the partial stream 22 e.g., by a force exerted by the partial stream 22 against the valve ball. As soon as the control element 3 opens, the second cyclone 1 which is shown below in FIG. 6, has a partial stream of the crankcase ventilation gas flowing through in parallel with the first cyclone 1. Thereby the apparatus will operate in a smaller, as well as in a larger, volume stream in a favorable separating area of the cyclones 1.

Also in the second lower arranged cyclone 1, the gas to be cleaned will enter the cyclone 1 through a gas inlet 11. The cleaned gas will leave the second cyclone upwards through a gas outlet 12, and the separated oil will flow downwards into the outlet 13 and is guided back preferably to the oil sump of the internal combustion engine together with the separated oil from the first upper cyclone 1.

After the two cyclones 1, the partial streams 21, 22 are re-united into a common cleaned volume stream 2 and guided away, preferably into the suction passage of the associated internal combustion engine.

In an embodiment not illustrated the oil outlets 13 of the oil separating elements 1 open into a common oil collection vessel which is arranged directly after the oil outlets 13. Therein the oil collecting vessel is connected to the crankcase by a valve which is a so called check valve. In this fashion it is avoided that the oil outlets 13 of the oil separating elements are impinged with the crankcase pressure. For draining the collected oil, the check valve will open part time such that the oil may flow into the crankcase. The check valve may also be designed as a siphon. In order to avoid a non-required gas stream through the oil outlet 13 of that oil separating element 1, whose gas inlet or gas outlet is closed by the control element 3, this oil outlet 13 comprises an additional control element 3" which may open or close, respectively, the oil outlet 13 to the oil collection vessel.

In a further non-illustrated embodiment the oil outlets 13 of at least two oil separating elements 1 arranged in parallel open into a dedicated oil collecting vessel which is connected to the crankcase by a check valve. In this case the check valves also have the function of the additional control element 3" mentioned above.

Figure 7:
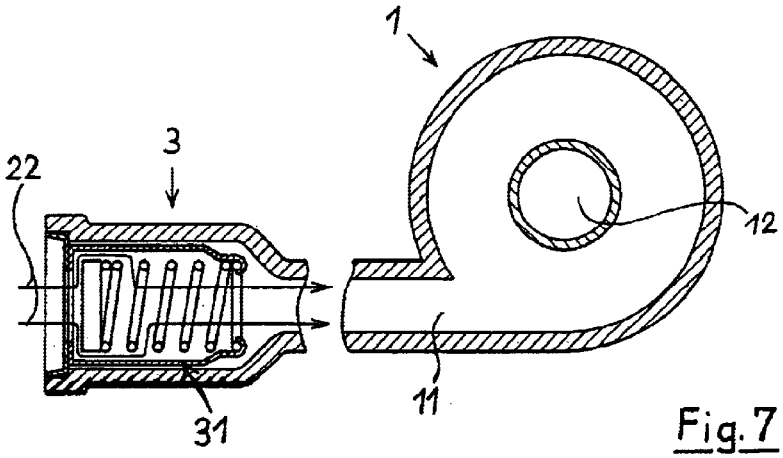
FIG. 7 is a top cross-sectional view of a cyclone with an upstream arranged control element as a part of the apparatus of FIG. 6.

FIG. 7 of the drawing illustrates an embodiment for the cyclone 1 in a cross-section, with a control element 3 in form of a valve 31 arranged upstream. The valve 31 in this case is mounted as a prefabricated unit in a pipe connection piece which is arranged in the course of the partial stream 22 to the gas inlet of the cyclone 1. The prefabricated unit is pressed in. By means of a spring a valve plate it is biased in a closing direction. The valve plate may be raised from the valve seat against the force of the spring by the partial stream 22 as soon as this partial stream 22 is large enough such that the partial stream 22 gets through the control element 3 to the gas inlet 11 of the cyclone 1, and thereafter flows through the cyclone 1. In the center of the cyclone 1 a part of the gas outlet 12 is visible.

Figure 8:
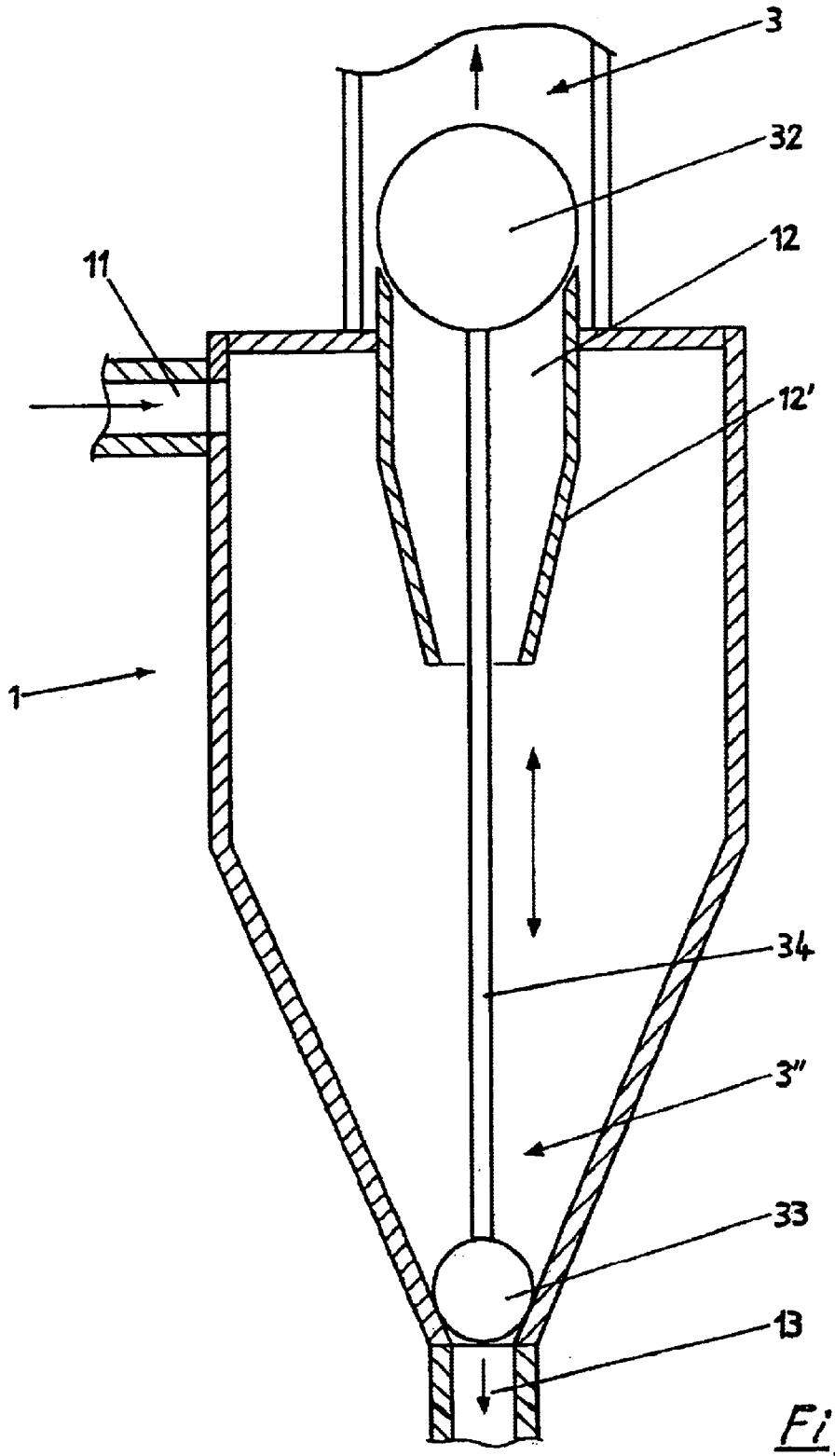
FIG. 8 is a longitudinal cross-sectional view of a cyclone as a part of the apparatus.

FIG. 8 of the drawing illustrates an example for a cyclone 1 as an oil separating element wherein a control element in the gas outlet 12 is provided as well as an additional control element 3" in the oil outlet 13. The gas to be cleaned enters into the interior of the cyclone 1 through the gas inlet 11 arranged at the left upper side at the cyclone 1, and is subject to a rotating flow impinged by the cyclone. The oil droplets will precipitate at the inner surface of the cyclone 1 by means of the centrifugal force, and flow downwards in direction to the oil outlet 13. The cleaned gas relieved of the oil droplets will flow upwards in the center of the cyclone 1 through a central submerged pipe 12' in the direction of the gas outlet 12.

In this case, the control element in the gas outlet 12 is formed as a valve ball 32, which rests at the upper end of the submerged pipe 12' formed as an annular valve seat. In the area directly above the oil outlet 13 a second valve ball 33 is arranged which closes the oil outlet 13 in its lower position as it is illustrated in FIG. 8. The valve ball 32 of the control element 3, and the valve ball 33 of the additional control element 3" are connected with each other by a coupling element 34 which is a straight thin and light rod such that they exert each movement in vertical direction in common.

In the illustrated condition wherein the two valve balls 32, 33 are in their closing position there is no gas flow through the cyclone 1.

As soon a sufficiently large volume stream arrives at the gas inlet 11 of the cyclone 1, the valve ball 32 is lifted upwards by the resulting differential pressure between the interior of the cyclone 1 and in the area of the gas outlet 12 above the valve ball 32. Hereby the gas outlet 12 is open for a flow of the cleaned gas. By this upward movement of the valve ball 32 the lower valve ball 33 is moved upward by the same distance whereby the oil outlet 13 arranged at the lower end of the cyclone 1 is also opened. Separated oil may flow downwards through the oil outlet 13.

In order to have the differential pressure lift the valve balls 32, 33 in a required fashion, the upper valve ball 32 is designed with a larger diameter than the lower valve ball 33. With an equal pressure differential between the interior of the cyclone, and the areas of the cyclone outside the valve balls 32, 33 always an upwards directed force will result opening the control element 3 and 3".

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonable and properly come within the scope of our contribution to the art.

What is claimed is:

1. A method for de-oiling crankcase ventilation gases from an internal combustion engine wherein the crankcase ventilation gases flow through an oil separating element and oil droplets contained in the stream are separated in the oil separating element, wherein a volume stream of the crankcase ventilation gases is divided into at least two partial volume streams, and at least one of said partial volume streams is guided through at least one said oil separating element, wherein a size of each of the at least two partial volume streams is controlled depending on a magnitude of the volume stream.

2. A method for de-oiling crankcase ventilation gases according to claim 1, wherein said oil separating element comprises a cyclone element.

3. An apparatus for de-oiling crankcase ventilation gases flowing in a volume stream from an internal combustion engine comprising:

at least two oil separating elements arranged downstream of the internal combustion engine to receive at least a portion of the volume stream;

at least one control element, through which at least a part of the volume stream is directed, arranged upstream of and in communication with at least one of the oil separating elements, to control a portion of the volume stream directed to the at least one of the oil separating elements, depending on a magnitude of the volume stream.

4. An apparatus according to claim 3, wherein the at least two oil separating elements are arranged in parallel.

5. An apparatus according to claim 4, wherein at least one control element comprises a common control element for all of the at least two oil separating elements.

6. An apparatus according to claim 4, wherein the at least one control element comprises a separate control element for each of the at least two oil separating elements.

7. An apparatus according to claim 6, wherein the control elements are arranged in series with their respective oil separating elements.

8. An apparatus according to claim 6, wherein the control elements are arranged in parallel with their respective oil separating elements.

9. An apparatus according to claim 6, including a further common control element arranged upstream of all of the separate control elements.

10. An apparatus according to claim 3, wherein the at least two oil separating elements are arranged in series with at least one oil separating elements arranged downstream of another oil separating element.

11. An apparatus according to claim 10, wherein the at least one control element comprises a separate control element for each of the at least two oil separating elements.

12. An apparatus according to claim 11, wherein the control elements are arranged in series with their respective oil separating elements.

13. An apparatus according to claim 12, wherein each control element is arranged to divide the volume stream guided thereto into two partial streams, depending on the arriving volume stream, wherein one of these partial streams flows through an associated oil separating element and to the control element in front of the downstream arranged oil separating element, and the other partial stream flows into a bypass line, which line passes by the downstream arranged oil separating element.

14. An apparatus according to claim 3, wherein said oil separating elements comprise cyclone elements.

15. An apparatus according to claim 3, wherein the control element comprises a passive element which can be actuated directly by at least a part of the volume stream.

16. An apparatus according to claim 3, wherein the control element is an active element which can be actuated by a control signal resulting from measuring at least a part of the volume stream.

17. An apparatus according to claim 16, wherein a measuring device for measuring at least a part of the volume stream comprises a wire through which an electrical current is directed, and the control element is electrically actuated.

18. An apparatus according to claims 3, wherein a measuring device for measuring the volume streams comprises a venturi pressure sensor, and the control element is actuated mechanically.

19. An apparatus according to claim 18, further including a diaphragm acting on a tappet of the control element for actuating the control element.

20. An apparatus according to claim 3, wherein the control element is arranged directly in a gas inlet of the associated oil separating element, and the control element is arranged to vary a gas inlet cross-section of the oil separating element between an open and a closed position.

21. An apparatus according to claim 20, wherein the control element is arranged to vary the inlet cross section in a continuously variable manner.

22. An apparatus according to claim 20, wherein the control element is arranged to vary the inlet cross section through a series of discrete steps.

23. An apparatus according to claim 3, wherein the control element is arranged directly in a gas outlet of the associated oil separating element, and the control element is arranged to vary a gas outlet cross-section of the oil separating element between an open and a closed position.

24. An apparatus according to claim 23, wherein the control element is arranged to vary the outlet cross section in a continuously variable manner.

25. An apparatus according to claim 23, wherein the control element is arranged to vary the outlet cross section through a series of discrete steps.

26. An apparatus according to claim 20, wherein in addition to the control element, an additional control element is arranged directly in an oil outlet of an associated oil separating element, and that the additional control is arranged to vary an oil outlet cross-section of the oil separating element between an open and a closed position.

27. An apparatus according to claim 26, wherein the additional control element is arranged to vary the oil outlet cross section in a continuously variable manner.

28. An apparatus according to claim 26, wherein the additional control element is arranged to vary the oil outlet cross section through a series of discrete steps.

29. An apparatus according to claim 26, wherein the control element and the additional control element are coupled with each other to move in common.

30. An apparatus according to claim 29, wherein the control element and the additional control element each comprise a valve ball which is biased in a closing direction, wherein the valve ball of the control element has a larger diameter than the valve ball of the additional control element and wherein the two valve balls are connected by a coupling element for common adjustment.

31. An apparatus according to claim 4, wherein oil outlets of the at least two oil separating elements open into a common oil collecting vessel which is connected to a crankcase of the internal construction engine by a valve, wherein the oil outlet of at least one oil separating element comprises an additional control element which is arranged to vary an oil outlet cross-section between an open and a closed position.

32. An apparatus according to claim 31, wherein the additional control element is arranged to vary the oil outlet cross section in a continuously variable manner.

33. An apparatus according to claim 31, wherein the additional control element is arranged to vary the oil outlet cross section through a series of discrete steps.

34. An apparatus according to claim 4, wherein the oil outlets of the at least two oil separating elements each open into a dedicated oil collecting vessel which is connected to crankcase of the internal combustion engine by a valve.

* * * * *